United States Patent [19]

Fujimaki

[11] Patent Number: 4,984,783

[45] Date of Patent: Jan. 15, 1991

[54] WATER SLIDERS WITH TURNING TOBOGGANS

[75] Inventor: Yoko Fujimaki, Shizuoka, Japan

[73] Assignee: Shiratori Co. Ltd., Shizuoka, Japan

[21] Appl. No.: 424,709

[22] Filed: Oct. 20, 1989

[51] Int. Cl.[5] ..... A63G 3/00

[52] U.S. Cl. ..... 272/565 R; 104/70

[58] Field of Search ..... 272/56.5 R, 56.5 SS; 104/69, 70; 193/12, 2 R, 14, 38

[56] References Cited

U.S. PATENT DOCUMENTS

| | | | |
|---|---|---|---|
| 3,508,405 | 4/1970 | Koch | 272/56.5 R |
| 3,830,161 | 8/1974 | Bacon | 104/90 |
| 4,149,710 | 4/1979 | Rouchard | 272/56.5 R |
| 4,391,201 | 7/1983 | Bailey | 104/70 |
| 4,836,521 | 6/1989 | Barber | 272/56.5 R X |

*Primary Examiner*—Richard E. Chilcot, Jr.

[57] ABSTRACT

The present invention provides a water slider used with a round or substantially round tobogganing boat designed to be displaced into contact with one side of a slide lane in the course of toboganning. A side wall of the slide lane comes into contact with the boat and has a nearly vertical portion brought in contact with a side or side edge of the boat, thereby increasing the friction between the side wall and the boat to substantially or completely eliminate any relative slippage therebetween. The slide lane may be provided on one side with a slight dent.

2 Claims, 2 Drawing Sheets

WATER SLIDERS WITH TURNING TOBOGGANS

BACKGROUND OF THE INVENTION

1. Field of the Invention

The present invention relates to a water slider on which a round or substantially round toboggan or sliding boat is designed to toboggan or slide down and, more specifically, to a water slider on which a toboggan is designed to come into contact with one side wall of a slide lane and turn during tobogganing.

2. Prior Art

A water slider is a type of a slide including a slide lane in the form of a gutter. Water is then let run on the slide lane to form a stream of water with which a toboggan or boat tobogans or slides down on the slide lane.

Referring to such a water slider, the frictional resistance between the boat and the slide face is extremely reduced by a stream of water and the sliding-down speed of the boat is controlled by a flow rate of water. The heat of friction generated on the slide face is thus not only extremely reduced but is also absorbed in the stream of water. For that reason, the water slider has its slide lane extended and, on its way, inclined varied angles, turned right and left and curved, enabling players to experience a thrill with suitable speed.

However, the use of such a water slider as mentioned above is limited to the summer season, since players should toboggan with swimming suits on because of water being let run on the slide lane.

In recent years, there has been developed a large-sized water slider having its slide lane so enlarged in width that a rubber boat with a player inside can slide down thereon.

With such a water slider, it is not always required for players to have swimming suits on, since their bodies are in no direct contact with water during toboganing or sliding-down. Thus, this water slider can be used all the year round, and has an additional merit of stirring up much deeper interest in tobogganing, because a set of players can slide down thereon.

However, that water slide has its slider face formed into a semi-cylinderical shape and approaching the side walls at an increased angle of inclination, so that a boat can always slide down on the middle of the slide lane. Since tobogganing becomes monotonous in this regard, players' interest in tobogganing as such is thus impaired.

In view of such problems as mentioned above with the prior art water slider, it is therefore an object of the present invention to provide a water slider on which a toboggan or sliding boat is designed to turn in the course of tobogganing or sliding-down, enabling players to experience a more thrill and entertain a more lively concern for tobogganing or sliding-down.

SUMMARY OF THE INVENTION

According to the present invention, there is provided a water slide used with a round or substantially round sliding boat designed to be displaced into contact with one side of a slide lane in the course of sliding-down, said side wall of said slide lane to come into contact with said boat having a nearly vertical portion brought in contact with a side or side edge of said boat, thereby increasing the friction between said side wall and said boat to substantially or completely eliminate any relative slippage therebetween, and with said boat in contact with said portion, said boat turning inevitably due to braking being applied to the resulting point of contact.

To displace the sliding boat toward one side of the slide lane, a portion of a slide face formed by curving the slide lane is formed into a substantially flat plane, on which the sliding boat slides sideways on the slide lane due to inertia. Alternatively, a slight dent may be provided in any suitable position of the slide lane located in the vicinity of its one side with the slide face being tilted down toward such a position, whereby the sliding-down course of the boat is located in the vicinity of one side of the slide lane to displace the boat toward said one side of slide lane at that position.

According to the water slider provided by the present invention, the portion of the slide face formed by curving the slide plane is shaped into a substantially flat plane, or a slight dent is provided in a suitable position of the slide plane located in the vicinity of its one side to tilt the slide face down toward it, whereby the sliding boat is displaced with a stream of water toward said one side of the slide lane at that position and brought into contact with the wall of said one side. Thereupon, the sliding boat stops sliding down due to braking applied to the point of contact of it with said side wall, and then slides down on the slide plane while turning due to a rotational force applied around that point.

BRIEF DESCRIPTION OF THE DRAWINGS

A preferred embodiment of the water slider according to the present invention will now be explained specifically but not exclusively with reference to the accompanying drawings, in which.

PREFERRED EMBODIMENT OF THE INVENTION

Figure 1:
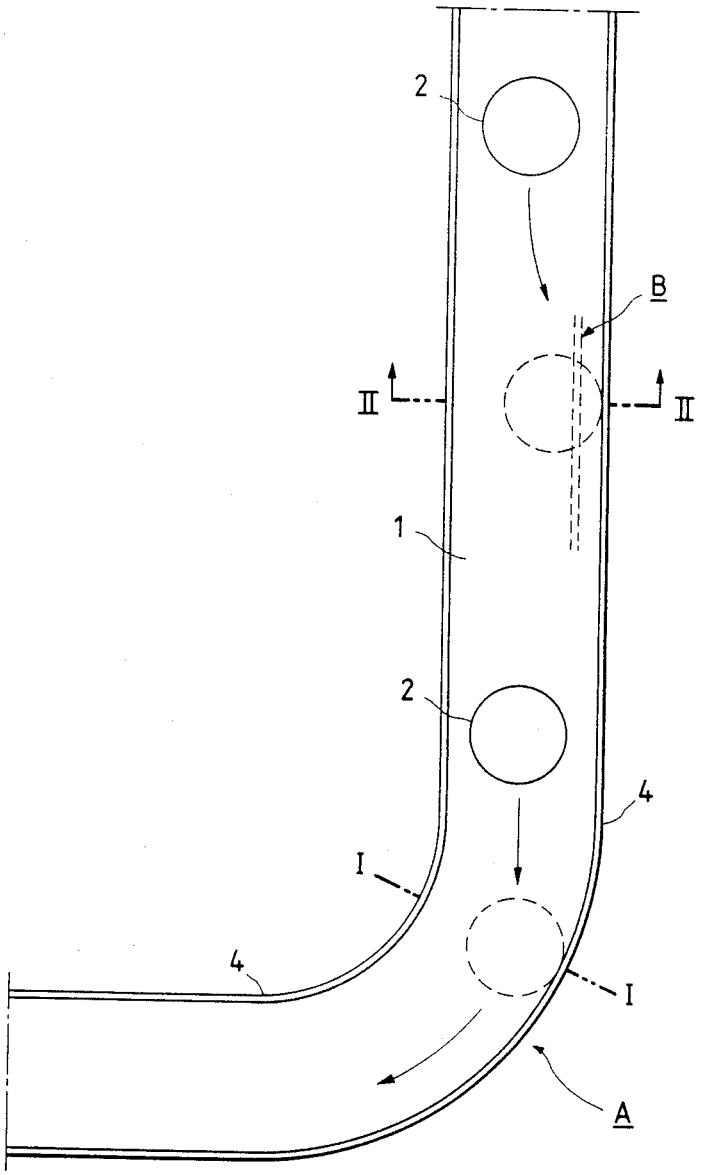
FIG. 1 is a plan view illustrating a part of a slide lane of one embodiment of the water slider according to the present invention.
Figure 2:
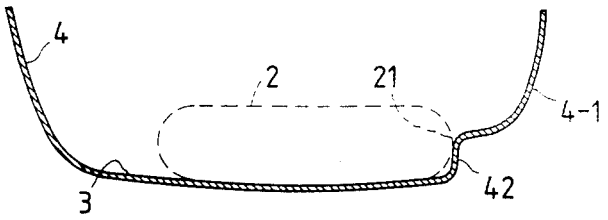
FIG. 2 is an enlarged section taken along the line I—I of FIG. 1.
Figure 3:
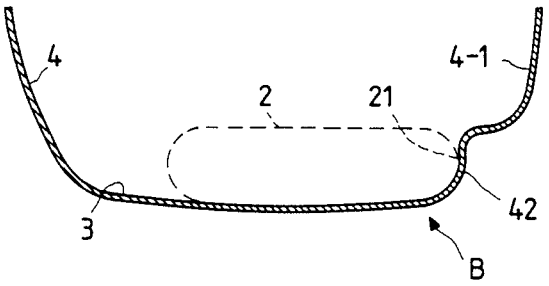
FIG. 3 is an enlarged section taken along the line II—II of FIG. 1.

Referring to the drawings, FIG. 1 is a plan view of a slide lane 1 and FIGS. 2 and 3 are longitudinally sectioned views illutrating a toboggan or sliding boat 2 displaced to one side of the slide lane.

The water slider is similar to an ordinary one available in the art, except a portion of the slide lane 1 for turning the sliding boat 2.

More specifically, the slide lane 1 comprises a slider face 3 and both side walls 4, and is provided in the form of a gutter generally approximating to a semi-cylinder by a gentle concavity of the slide face 3. The slide lane 1 is not only turned right and left and curved but is also inclined down at a suitable angle. A suitable amount of water is then let run on the lane 1, thereby reducing the coefficient of friction between the slide face 3 and the sliding boat 2 to an extremely low value, so that the sliding boat 2 can finally stop in a pond or pool after passing on the vicinity of the center of the lane 1.

Referring then to FIG. 2, the sliding boat 2 is designed to turn at a position A at which the lane 1 is curved. At this position A, the slide face 3 is shaped into a substantially flat plane. Hence, the boat 2 sliding down on the lane 1 at a suitable speed tends to slide down substantially linearly at the position A due to inertia. For that reason, the sliding boat 2 is apparently displaced toward one side (the right side in FIG. 2) of the slide lane 1 and brought into contact with the outer side wall $4_{-1}$.

On the other hand, a portion 42 of the side wall $4_{-1}$ in contact with the sliding boat 2 (more specificaly, a portion in contact with its side 21 or side edge; a portion in contact with the side 21 of the boat 2 in FIG. 2) is so nearly vertical that it comes into contact with the boat 2 with increased friction. Thus, the boat 2 and said portion 42 do not slip each other substantially or at all.

With the sliding boat 2 in contact with the side wall, therefore, the boat 2 stops sliding down due to braking applied to the point of contact of the boat 2 with the side wall. Then, the boat 2 slides down while turning (counterclock in FIG. 2) around that point by rotational force applied thereto.

It is understood that as illustrated, the slide face 3 is made substantially horizontal in section at the position A at which the sliding boat 2 is to turn. However, if that face 3 is sloped down in the right direction in FIG. 2, the sliding boat 2 is then displaced right into contact with the side wall $4_{-1}$ with increased force, whereas if it is at an upward slope, the sliding boat 2 then comes into contact with the side wall $4_{-1}$ with decreased force. The smaller the curvature of the slide lane 1 at that position A and the higher the tobogganing speed of the boat 2, the more likely is it that there may be an increase in the force with which the boat 2 comes into contact with the side wall $4_{-1}$. In view of such considerations, that slope is determined so as to allow the boat 2 to come into contact with the side wall $4_{-1}$ with suitable force.

Therefore, the slider face 3 need not be a flat plane in a strict sense, and may so be slightly bent within such an extent that the tobogganing boat 2 is brought into contact with the side wall $4_{-1}$ with the desired force.

FIG. 3 illustrates that the tobogganing boat 2 is caused to turn at a suitable position on the slide lane 1.

At that position, the slide lane 1 is provided on one side (the right side in FIG. 3) with a slight dent shown at B, toward which the slide face 3 slopes down.

At that position, therefore, the slide face 3 slopes down toward the slight dent B, so that the tobogganing course of the boat 2 remains curved toward the dent B. For that reason, the tobogganing boat 2 is diplaced at that position toward one side (the right side in FIG. 3) of the slide lane 1 into contact with the side wall $4_{-1}$.

On the other hand, since this portion of the side wall $4_{-1}$, i.e., the portion 42 to come into contact with the tobogganing boat 2 is formed into substantial vertical, its friction with the boat 2 is so increased that there is little or no relative slippage therebetween.

It is noted that the tobogganing boat 2 is in the form of a true or substantial true circle having an outer diameter of about 1.5 to 3.0 meters with no difference from stem to stern.

Basically, the tobogganing boat 2 is substantially similar to an ordinary one. That is, the tobogganing boat 2 is a sort of rubber boat which is as a whole flexible and, in particular, has its bottom deforming following the curved slide face 3 of the slide lane 1, thereby causing it to come into uniform contact with the slide face 3.

As detailed above, the present invention provides a water slider including a curved slide lane which has a slide face substantially flattened at a position at which a tobogganing boat is to turn, or which is provided on one side of its suitable position with a slight dent, toward which the slide face slopes down. At such a position, the tobogganing boat is displaced with a stream of water to one side of the slide lane into contact with the side wall. On the other hand, the side wall of the lane 1 to come into contact with the boat is made substantially vertical to increase its friction with the boat, thereby eliminating any their relative slippage.

Hence, the tobogganing boat 2 is displaced at that position to one side of the slide lane 1 into contact with the side wall. Thereupon, the boat stops tobogganing at the point of contact of it with the side wall. Then, it toboggans while turning around at that point with rotational force applied thereto. Thus, more pleasant speed changes and thrills are given to players, arousing much deeper interest in water tobogganing.

What is claimed is:

1. A water slider used with a round or substantially round tobogganing boat designed to be displaced into contact with one side thereof in the course of tobogganing, said water slider comprising opposing side walls and a connecting slide surface, a side wall of said slide lane which contacts said boat having a substantially vertical portion which contacts a side or side edge of said boat, thereby increasing the friction between said side wall and said boat to substantially or completely eliminate any relative slippage between said boat and said side wall, said water slider including a curved portion having a slide face formed into a substantially flat plane which causes said boat to slide down in a substantially linear direction, while at the same time being displaced to one side of said water slider into contact with said side wall.

2. A water slider used with a round or substantially round tobogganing boat designed to be displaced into contact with one side thereof in the course of tobogganing, said water slider comprising opposing side walls and a connecting slide surface, a side wall of said slide lane which contacts said boat having a substantially vertical portion which contacts a side or side edge of said boat, thereby increasing the friction between said side wall and said boat to substantially or completely eliminate any relative slippage between said boat and said side wall, said water slider being provided at a position located near one side thereof with a portion which is displaced inwardly from said side wall, said slide surface being sloped downwardly in a lateral direction toward said inwardly displaced portion, whereby said boat is caused to be directed laterally along said sloping surface into contact with said side wall having said inwardly displaced portion.

* * * * *